US006877970B2

(12) United States Patent
Tange et al.

(10) Patent No.: US 6,877,970 B2
(45) Date of Patent: Apr. 12, 2005

(54) APPARATUS FOR MAKING WEB COMPRISING CONTINUOUS FIBERS

(75) Inventors: Satoru Tange, Kagawa-ken (JP); Toshio Kobayashi, Kagawa-ken (JP)

(73) Assignee: Uni-Charm Corporation, Ehime-Ken (JP)

( * ) Notice: Subject to any disclaimer, the term of this patent is extended or adjusted under 35 U.S.C. 154(b) by 288 days.

(21) Appl. No.: 10/122,209

(22) Filed: Apr. 16, 2002

(65) Prior Publication Data

US 2002/0155185 A1 Oct. 24, 2002

(30) Foreign Application Priority Data

Apr. 18, 2001 (JP) ..... 2001-120282

(51) Int. Cl.[7] ..... D01D 5/098; D04H 3/03
(52) U.S. Cl. ..... 425/66; 425/72.2; 425/83.1
(58) Field of Search ..... 425/66, 72.2, 83.1

(56) References Cited

U.S. PATENT DOCUMENTS 3,325,906 A 6/1967 Franke
3,773,483 A * 11/1973 Schmidt ..... 264/210.8
5,439,364 A * 8/1995 Gerking et al. ..... 425/66
5,460,500 A * 10/1995 Geus et al. ..... 425/66
5,714,171 A 2/1998 Profe
5,766,646 A 6/1998 Geus et al.
5,820,888 A * 10/1998 Geus et al. ..... 425/66
5,968,557 A 10/1999 Weger et al.
6,379,136 B1 * 4/2002 Najour et al. ..... 425/66
6,663,823 B2 * 12/2003 Kobayashi et al. ..... 425/66

FOREIGN PATENT DOCUMENTS

JP 48 38025 11/1973

* cited by examiner

*Primary Examiner*—James P. Mackey
(74) *Attorney, Agent, or Firm*—Lowe Hauptman & Berner, LLP

(57) ABSTRACT

An apparatus for producing a web of continuous fibers having a melt extruder, an endless belt running in one direction and a guide box located between the extruder and the belt. The guide box has front and rear walls as viewed in the running direction of the belt, a pair of side walls extending between the front and rear walls and upper and lower end openings. The fibers extruded from the extruder enter the upper end opening by suction exerted in the vicinity of the lower end opening. The guide box is formed in the front wall and/or the rear wall with intermediate opening(s) serving to introduce the outside air into the guide box.

1 Claim, 3 Drawing Sheets

APPARATUS FOR MAKING WEB COMPRISING CONTINUOUS FIBERS

BACKGROUND OF THE INVENTION

This invention relates to an apparatus for making a web comprising thermoplastic synthetic resin fibers.

Japanese Patent Application Publication No. 1973-38025B discloses an invention entitled "Process and apparatus for making nonwoven sheet- and fleece-like fibrous assembly from a plurality of melt spun single yarn filaments". According to this invention, a web comprising a plurality of melt spun continuous filaments is obtained in a form of fabricated fibers. The filaments are guided into a sucker located at a lower side of a melt extruder by a distance sufficient to solidify the filaments before entering the sucker. Inside the sucker, air-jet-flow acts on both sides of a plurality of the filaments arrayed along the longitudinal direction of the sucker so that the filaments may be cooled and stretched as these filaments are sent to the lower side of the sucker. Immediately below the sucker, a collecting belt runs upon which a plurality of the filaments are assembled to form the fabricated fibers in a form of spun bond nonwoven fabric or the like.

U.S. Pat. No. 5,439,364 discloses an apparatus for making a fibrous web comprising a plurality of continuous filaments. In the case of this apparatus, a plurality of filaments extruded from a plurality of nozzles of an extruder and arrayed in a line are quenched and then introduced into a drawing off passage through its rectangular upper end opening. A lower end opening of this drawing off passage is in contact with a peripheral surface of a rotary drum having a plurality of openings on the peripheral surface. In the drawing off passage, suction induced from inside the rotary drum is exerted not only at its lower end but also at its intermediate region defined between the upper and lower end openings so that the filaments may be accumulated on the peripheral surface of the rotary drum after introduced into the drawing off passage. The drawing off passage is structured to be narrow in its width in a rotational direction of the drum in the vicinity of the upper end opening and abruptly enlarged in the vicinity of the lower end opening.

The problem common to the above-cited inventions is to distribute a plurality of filaments as evenly as possible in the longitudinal direction as well as in the transverse direction of the collecting belt serving as a conveying means for the web and the rotary drum without locally intertwined in many layers and thereby to obtain the fibrous web in which the fibers are uniformly distributed. However, in the apparatus disclosed in Japanese Patent Application Publication No. 1973-38025B, the sucker and the collecting belt running immediately below the sucker are separated each other only by a distance $h_2$ and the air ejected from the narrow lower end of the sucker may generate a turbulent flow of air in a gap defined by this distance $h_2$. Such turbulent flow of air may prevent the filaments from being evenly distributed.

In the case of the apparatus disclosed in U.S. Pat. No. 5,439,364, the drawing off passage is subjected, in the vicinity of its upper end opening, to the suction effect provided from the interior of the rotary drum and from the intermediate region but, in the region lower than the intermediate region, to the suction effect provided from the interior of the rotary drum. In consequence, the suction effect is relatively weak in this lower region. The filaments introduced into the drawing off passage descend at a correspondingly reduced velocity in the region lower than the intermediate region and are evenly received on the peripheral surface of the rotary drum. In this manner, this apparatus of well known art requires double suction system, one provided from the rotary drum and the other provided from the intermediate region. This requirement necessarily complicates the apparatus and operational control of the apparatus.

SUMMARY OF THE INVENTION

It is an object of this invention to provide an apparatus simplified in structure for making a web comprising continuous fibers of a thermoplastic synthetic resin improved so that the continuous fibers can be evenly distributed without being locally intertwined.

According to this invention, there is provided an apparatus for making a web comprising continuous fibers from a thermoplastic synthetic resin, the apparatus including a melt extruder located at a higher position and a conveying means located at a lower position and running in one direction so that the continuous fibers of the thermoplastic synthetic resin extruded from the melt extruder may be temporarily received on the conveying means, a guide box located between the extruder and the conveying means and having an upper end opening located below nozzles of the extruder by a desired dimension in distance so as to introduce the continuous fibers into the guide box and a lower end opening dimensioned to be larger than the upper end opening as viewed from a side of the guide box along one direction in which the conveying means runs, and a suction means located opposing to the lower end opening of the guide box with the conveying means therebetween to ensure that the continuous fibers are guided through the upper end opening into the guide box and temporarily received on the conveying means wherein the guide box has front and rear walls as viewed orthogonal to the direction in which the conveying means runs and a pair of side walls extending between the front and rear walls, and opposing to each other in a direction parallel to the direction.

The front wall and/or the rear wall is or are provided with intermediate opening(s) lying between the upper and lower end openings and allowing an air flow between exterior and interior of the guide box.

DETAILED DESCRIPTION OF THE PREFERRED EMBODIMENTS

Details of an apparatus for making a web comprising continuous fibers will be more fully understood from the description of the apparatus for making a spun bond nonwoven fabric as a specific embodiment of the web given hereunder in reference to the accompanying drawings.

Figure 1:
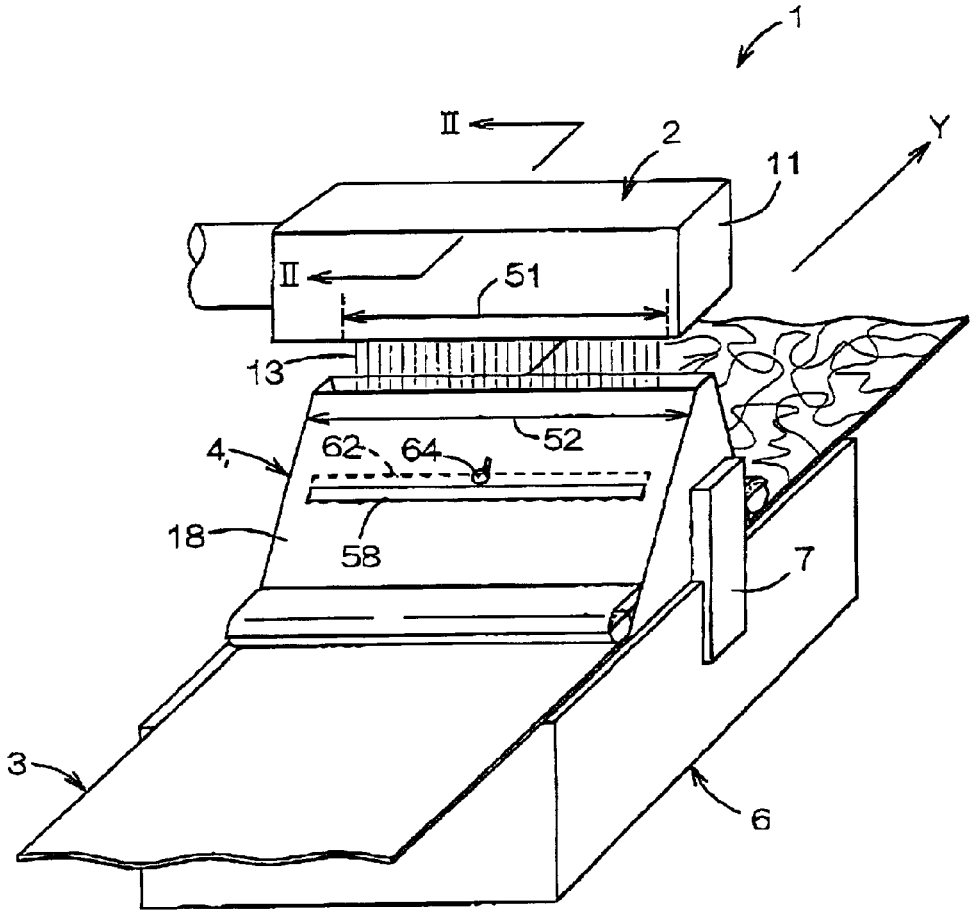
FIG. 1 is a perspective view of the apparatus according to this invention.

FIG. 1 is a fragmentary perspective view showing an apparatus 1 according to this invention for making a nonwoven fabric. The apparatus 1 comprises a melt extruder 2, an endless belt 3 located below the extruder 2 and serving as a conveying means, a guide box 4 located between the extruder 2 and the endless belt 3 and a suction box 6 opposed to the guide box 4 with the endless belt 3 therebetween. The endless belt 3 is adapted to run in a direction indicated by an arrow Y and made of a breathable belt so that suction may be exerted onto the guide box 4 as the endless belt 3 runs above the suction box 6. The guide box 4 is supported by lateral struts 7 in a vertically movable fashion. The extruder 2 includes a plurality of extrusion nozzles 12 (See FIG. 2)

arranged over a dimension in length 51 in a transverse direction of the endless belt 3 and the guide box 4 has a dimension in length 52 in the transverse direction of the endless belt 3. While these dimensions in length 51, 52 are not particularly specified, in general, the transversal dimension in length 51 is in a range of 50–3500 mm and the transversal dimension in length 52 is in a range of 100–3700 mm.

Figure 2:
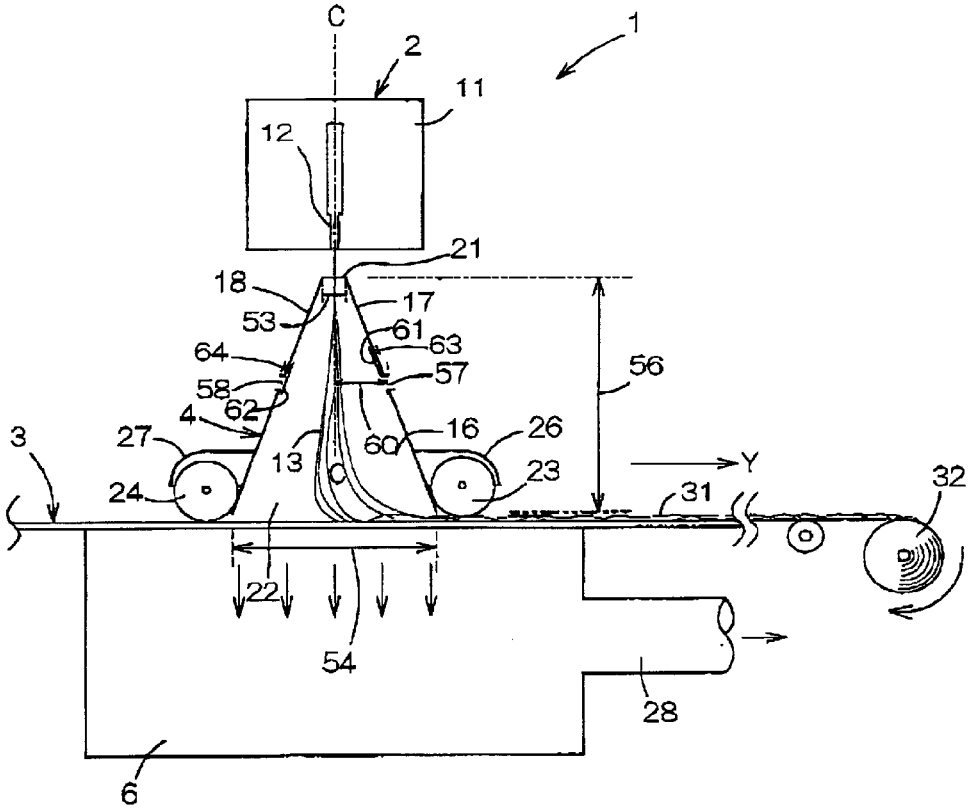
FIG. 2 is a cross-sectional view taken along a line II—II in FIG. 1.

FIG. 2 is a cross-sectional view taken along a line II—II in FIG. 1. Inside a head 11 of the extruder 2, a plurality of molten fibers 13 of a thermoplastic synthetic resin are continuously extruded from a plurality of the extrusion nozzles 12 rectified in parallel one to another, which are then stretched and become thinner in dimension.

Referring to FIG. 2, the guide box 4 lying below the head 11 has a pair of side walls 16 (See FIG. 1 also) in the vicinity of transversely opposite side edges of the belt 3 and front and rear walls 17, 18 as viewed from a direction orthogonal to a longitudinal direction of the belt 3. The guide box 4 is trapezoidal in its cross section viewed along the longitudinal direction of the belt 3 and has an upper end opening 21 lying immediately below the extrusion nozzles 12 and a lower end opening 22 lying closely above the upper surface of the belt 3 and being larger than the upper end opening 21 in dimension as viewed along the longitudinal direction of the belt 3. In a preferred embodiment of the guide box 4, the upper end opening 21 has a dimension in width 53 in a range of 2–50 mm in the longitudinal direction of the belt 3, the lower end opening 22 has a dimension in width 54 of 50–1000 mm in the longitudinal direction of the belt 3 and a dimension in height 56 between these two openings 21, 22 in a range of 50–1000 mm. The front and rear walls 17, 18 are respectively formed with intermediate openings 57, 58 extending in the transverse direction of the endless belt 3 (See FIG. 1 also). These two openings 57, 58 are associated with shutter plates 61, 62, respectively, adapted to be vertically movable in the guide box 4 so that the opening area of the intermediate openings 57, 58 can be adjusted by manipulating respective knobs 63, 64 provided on the outer surface of the guide box 4. Referring to FIG. 2, the intermediate opening 57 on the front side is open while the intermediate opening 58 on the rear side is in a closed state (See FIG. 1 also). These intermediate openings 57, 58 are arranged so as to lie at a position separated by a distance 60 which is preferably of 5–400 mm, more preferably of 10–300 mm and most preferably of 30–200 mm in a horizontal direction from the center line C—C bisecting vertically the length of the upper end opening 21 of the guide box 4 in the longitudinal direction of the endless belt 3. The intermediate opening(s) 57, 58 may be formed on at least one of the front and rear walls 17, 18 and the dimensions of the intermediate openings 57,58 are determined in such a manner as to maintain a relationship between A and B to be A:B=20:1–2.5:1, wherein A is an opening area of the upper end opening 21 and B is a total opening area B of these intermediate openings 57, 58. The intermediate openings 57, 58 preferably extend in the direction orthogonal to the running direction of the belt 3 as in the illustrated embodiment. However, it is also possible to divide the respective intermediate openings 57, 58 into a plurality of openings and distribute these divided openings on the front and rear walls 17, 18 in an appropriate layout.

Outside the front and rear walls 17, 18, respectively, there are provided front and rear rollers 23, 24 in the vicinity of the lower end openings 22. These rollers 23, 24 rotate in the running direction Y of the belt 3 as the latter advances. These rollers 23, 24 can be slightly shifted in a vertical direction and can substantially close a gap between lower ends of the front and rear walls 17, 18 and the upper surface of the belt 3. Specifically, the front and rear rollers 23, 24 are mounted on the front and rear walls 17, 18, respectively, so that the front roller 23 can close a gap between the lower end of the front wall 17 of the guide box 4 and a fibrous web 31 on the belt 3 and the rear roller 24 can close a gap between the lower end of the rear wall 18 of the guide box 4 and the upper surface of the belt 3. Upper halves of the respective rollers 23, 24 are covered with covers 26, 27 extending from the front and rear walls 17, 18.

The suction box 6 is connected via a pipe 28 to a vacuum pump (not shown). Suction exerted on the guide box 4 by the suction box 6 causes the outside air to flow through the relatively narrow upper end opening 21 into the guide box 4 and forces this air to flow toward the lower end opening 22. Depending on an intensity of suction, such air flow is effective to maintain a plurality of continuous fibers 13 in a rectified state even after extruded from the extrusion nozzles 12 aligned in the transverse direction of the belt 3 and maintain or increase the velocity of these continuous fibers 13 after extruded, in the vicinity of the upper end opening 21. In addition, this air flow enables the fibers 13 to be stretched and thinned again in the vicinity of the opening 21. The fibers 13 are cooled in a rectified or substantially rectified state before the fibers 13 are collected on the belt 3 without any apprehension that the fibers 13 might be cut off or coalesced or intertwined to form a wad before collected.

The fibers 13 temporarily received on the belt 3 and placed one upon another will be coalesced if the fibers are in a molten state. However, if the fibers are not in a molten state will remain, as they are without being coalesced. These fibers 13 are conveyed in a form of web 31 to the direction Y through a narrow gap defined between the front wall 17 of the guide box 4 and the belt 3 and then taken up. The web 31 in which the fibers 13 are bonded together will be taken up as a spun bond nonwoven fabric 32. Outside the front wall 17, the front roll 23 is kept in contact with the upper surface of the web 31 as it rotates in a counterclockwise. The presence of the front roll 23 assures to prevent the outside air from flowing into the guide box 4 from a gap between the front wall 17 and the belt 3.

The guide box 4 with a trapezoidal cross-sectional shape having a relatively short upper side and a relatively long lower side is subjected to the suction from below as is illustrated in FIG. 2. The velocity of the fibers 13 having entered the guide box 4 substantially in a vertical direction generally tends to be decreased and the air flow tends to become turbulent as it advances from the upper end opening 21 toward the lower end opening 22. As a result, such turbulent air flow may cause undesired oscillation of the fibers 13 and may sometimes cause the temporarily received fibers 13 to be partially blown up. Such influence of the air flow may often cause the fibers 13 to be partially intertwined and thereby to unevenly distribute the fibers 13 in the longitudinal direction as well as in the transverse direction of the endless belt 3. These problems can be effectively avoided by the apparatus according to this invention. Specifically, the air flowing into the guide box 4 from outside through the intermediate openings 57, 58 formed in the front and rear walls 17, 18 thereof, respectively, suppresses occurrence of the turbulence which would otherwise be generated in the lower part of the guide box 4 and thereby alleviates oscillation of the fibers 13. The air entering the guide box 4 from outside through the intermediate openings 57, 58 flows along the inner surfaces of the front and rear walls 17, 18, respectively, and the presence of such air flow is effective also to prevent the air entering the guide box 4 through the upper end opening 21 from rebounding on the endless belt 3. In this way, it is not apprehended that the fibers 13 might be undesirably oscillated in the guide box 4 and therefore partially intertwined. Thus the fibrous web 31 is formed, in which the fibers 13 are evenly distributed on the endless belt 3 in its longitudinal direction as well as in its transverse direction. In order to obtain such fibrous web 31 efficiently, the opening area of these intermediate openings 57, 58 can be appropriately adjusted by controlling the shutter plates 61, 62.

Figure 3:
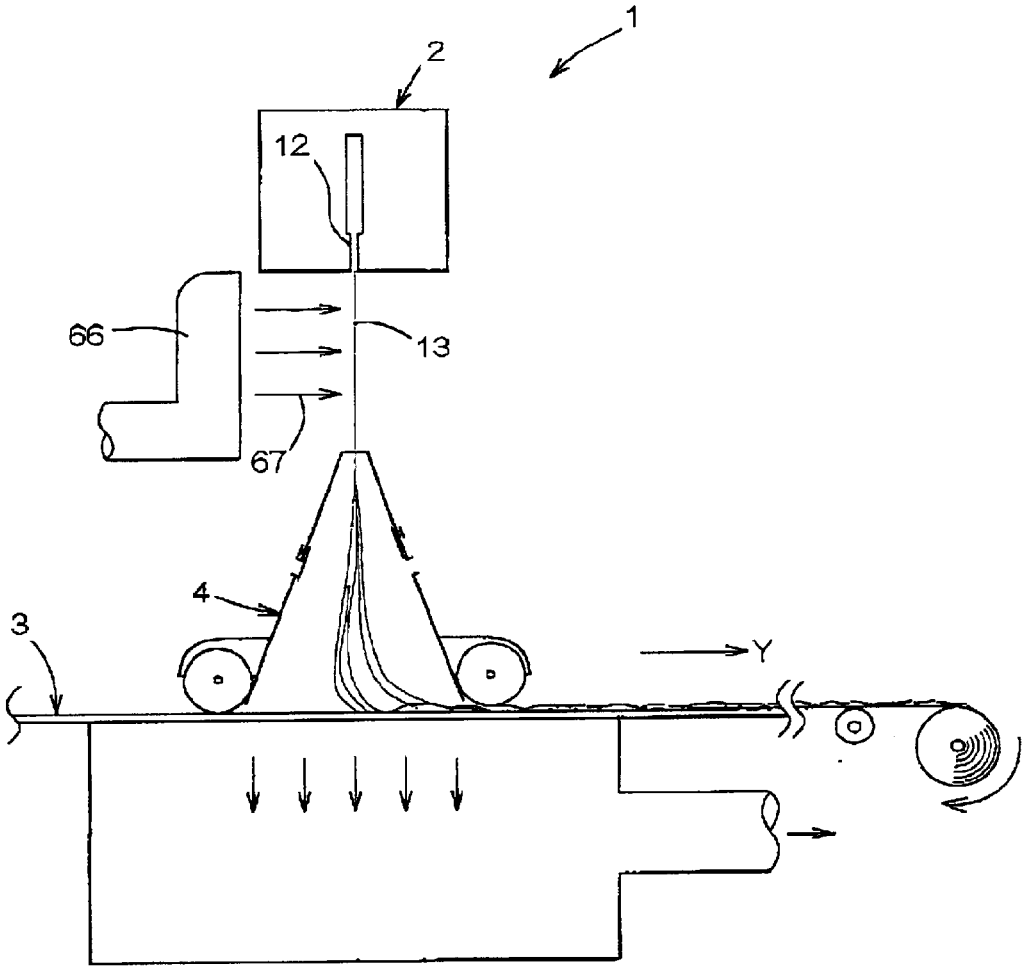
FIG. 3 is a view similar to FIG. 2 showing one preferred embodiment of this invention.

FIG. 3 is a view similar to FIG. 2 but showing one preferred embodiment of this invention. This apparatus 1 is provided immediately below the nozzles 12 with an air blowing device 66 from which a cooling air flow 67 is blown against the fibers 13 to cool the latter. The guide box 4 in this embodiment of the apparatus 1 is similar to that shown in FIG. 2 in that the continuous fibers 13 extruded from the nozzles 12 are rapidly cooled by the air flow 67 to a temperature lower than a softening temperature and then subjected to the suction in the guide box 4. In this way, the fibers 13 are stretched between the nozzles 12 and the air blowing device 66.

With the apparatus according to this invention for making a web, the continuous fibers extruded from the melt extruder enter the guide box in a substantially rectified state as in the state immediately after extruded from the nozzles and, in the guide box, the air flowing into the guide box from outside through the intermediate opening(s) of the front wall and/or the rear wall of the guide box serves to suppress oscillation of the continuous fibers with this unique arrangement, it is ensures that the fibrous web in which the fibers are evenly distributed can be obtained without any anxiety that the continuous fibers might be locally intertwined.

What is claimed is:

1. An apparatus for making a web comprising continuous fibers of a thermoplastic synthetic resin, said apparatus consisting essentially of:

a melt extruder having a plurality of nozzles from which the continuous fibers of said thermoplastic synthetic resin are to be extruded;

a conveyor running in a machine direction for collecting thereon the continuous fibers extruded from said melt extruder;

a guide box of a trapezoid shape located between said extruder and said conveyor and having an upper end opening at a small base of said trapezoid shape, said upper end opening being located immediately below the nozzles of said extruder and spaced from the nozzles by a free space of a desired dimension, and a lower end opening at a large base of said trapezoid shape, said lower end opening having a dimension measured in the machine direction larger than that of said upper end opening; and a single suction source located opposing said lower end opening of said guide box with said conveyor therebetween;

wherein said guide box has front and rear walls spaced in the machine direction and side walls extending between said front and rear walls;

at least one of said front and rear walls is provided with at least one intermediate opening lying between said upper and lower end openings end allowing an air flow between an exterior and an interior of said guide box;

said at least one intermediate opening is adjustable by at least a shutter operatively associated with said at least one intermediate opening;

said shutter comprises a plate moveable parallel to the respective front or rear wall in which the associated intermediate opening is formed; and each of said front and rear walls has only one said intermediate opening.

* * * * *